US007981854B2

(12) United States Patent
Fujii et al.

(10) Patent No.: US 7,981,854 B2
(45) Date of Patent: Jul. 19, 2011

(54) WRINKLE-REMOVING COMPOSITION COMPRISING A PROPOXYLATED/ETHOXYLATED ALKYL SURFACTANT

(75) Inventors: Motoko Fujii, Wakayama (JP); Akira Ishikawa, Wakayama (JP)

(73) Assignee: Kao Corporation, Tokyo (JP)

( * ) Notice: Subject to any disclaimer, the term of this patent is extended or adjusted under 35 U.S.C. 154(b) by 135 days.

(21) Appl. No.: 12/087,165

(22) PCT Filed: Mar. 6, 2007

(86) PCT No.: PCT/JP2007/054754

§ 371 (c)(1),
(2), (4) Date: Dec. 9, 2008

(87) PCT Pub. No.: WO2007/102616

PCT Pub. Date: Sep. 13, 2007

(65) Prior Publication Data

US 2009/0221467 A1 Sep. 3, 2009

(30) Foreign Application Priority Data

Mar. 7, 2006 (JP) ..... 2006-060708

(51) Int. Cl.
*C11D 1/722* (2006.01)
*C11D 1/825* (2006.01)

(52) U.S. Cl. ..... 510/287; 510/276; 510/278; 510/289; 510/308; 510/322; 510/327; 510/340; 510/421; 510/515

(58) Field of Classification Search ..... 510/276, 510/278, 287, 289, 308, 322, 327, 340, 421, 510/515
See application file for complete search history.

(56) References Cited

U.S. PATENT DOCUMENTS

| | | | | |
|---|---|---|---|---|
| 6,165,970 | A * | 12/2000 | Williams (nee Mac Beath) et al. | 510/480 |
| 6,277,808 | B1 * | 8/2001 | Tcheou et al. | 510/417 |
| 6,884,766 | B2 * | 4/2005 | DeClercq et al. | 510/322 |
| 2003/0146405 | A1 * | 8/2003 | Frankenbach et al. | 252/8.91 |
| 2005/0183204 | A1 * | 8/2005 | Guarin et al. | 8/115.51 |
| 2006/0277688 | A1 * | 12/2006 | Ishikawa et al. | 8/115.51 |

FOREIGN PATENT DOCUMENTS

| | | | |
|---|---|---|---|
| EP | 0 292 909 | A2 | 11/1988 |
| EP | 666 663 | A1 | 6/2006 |
| JP | 64-6174 | A | 1/1989 |
| JP | 10-25660 | A | 1/1998 |
| JP | 10-46471 | A | 2/1998 |
| JP | 10-58911 | A | 3/1998 |
| JP | 10-508911 | A | 9/1998 |
| JP | 2003-533598 | A | 11/2003 |
| JP | 2004-346464 | A | 12/2004 |
| JP | 2005-60865 | A | 3/2005 |
| JP | 2006-104648 | A | 4/2006 |
| JP | 2006-176920 | A | 7/2006 |
| WO | WO-96/15309 | A2 | 5/1996 |
| WO | WO-01/61100 | A2 | 8/2001 |

OTHER PUBLICATIONS

Extended European Search Report issued in European Patent Application No. 07715312.0 on Mar. 16, 2011.

* cited by examiner

*Primary Examiner* — Charles I Boyer
(74) *Attorney, Agent, or Firm* — Birch, Stewart, Kolasch & Birch, LLP

(57) ABSTRACT

The present invention relates to a wrinkle-removing composition containing a specific PO/EO-added compound represented by formula (1) and (b) a specific compound represented by formula (2):

$$R^1—Y—[(PO)_m/(EO)_n]—H \quad (1)$$

wherein $R^1$ is a hydrocarbon group having 10 to 22 carbon atoms, PO represents $C_3H_6O$, EO represents $C_2H_4O$, m and n each represent the added mole number on the average, m is a number of 3 to 100, n is a number of 1 to 10, (PO) and (EO) may be added in a random or block form, and the order in which (PO) and (EO) are added is not limited; and Y is —O—, —COO—, —CONH— or —NHCO—, $$R^2—Z—CH_2CH(OH)CH_2OH \quad (2)$$

wherein $R^2$ represents a hydrocarbon group having 5 to 20 carbon atoms, and Z is —O— or —COO—.

13 Claims, No Drawings

WRINKLE-REMOVING COMPOSITION COMPRISING A PROPOXYLATED/ETHOXYLATED ALKYL SURFACTANT

FIELD OF THE INVENTION

The present invention relates to a wrinkle-removing composition and a wrinkle-removing method.

BACKGROUND OF THE INVENTION

Washing of clothes for dry cleaning, such as suits, is difficult in the home, and as a method of removing wrinkles therefrom, there is generally a method of heat treatment such as ironing and steam pressing, but this operation is troublesome and texture may be deteriorated. Up to now, techniques of smoothing out wrinkles in clothes without heat treatment have been disclosed. However, the wrinkle-removing effect is insufficient.

JP-A 10-25660 discloses a method of removing wrinkled portions, which includes spraying wrinkled portions of clothes with a composition containing a specific water-soluble solvent such as hexylene glycol and isoprene glycol combined with water and merely leaving the clothes to remove the wrinkled portions. JP-A 10-508911, equivalent to WO-A 96/15309 discloses a wrinkle-reducing composition containing silicone and a coating-forming polymer, and JP-A 1-6174 discloses an art relating to an aqueous composition for removing wrinkles, which contains a specific alcohol, glycerol, a nonionic surfactant and water, and both. of the applications describe techniques of removing winkles by spraying textile fabrics with the composition followed by hanging the fabrics to make them naturally dried, or ironing them. JP-A 2003-533598 describes an art relating to a wrinkle-removing effect by a polymer composition containing a carboxylic acid moiety.

SUMMARY OF THE INVENTION

The present invention relates to a wrinkle-removing composition containing (a) a compound represented by formula (1) and (b) a compound represented by formula (2):

$$R^1—Y—[(PO)_m/(EO)_n]—H \quad (1)$$

wherein $R^1$ is a hydrocarbon group having 10 to 22 carbon atoms, PO represents $C_3H_6O$, EO represents $C_2H_4O$, m and n each represent the added mole number on the average, m is a number of 3 to 100, n is a number of 1 to 10, (PO) and (EO) may be added in a random or block form, and the order in which (PO) and (EO) are added is not limited; and Y is —O—, —COO—, —CONH— or —NHCO—, $$R^2—Z—CH_2CH(OH)CH_2OH \quad (2)$$

wherein $R^2$represents a hydrocarbon group having 5 to 20 carbon atoms, and Z is —O— or —COO—.

The present invention also provides a method of removing wrinkles in clothes which includes applying the above wrinkle-removing composition onto clothes, as well as use of the above composition as a wrinkle removing agent.

DETAILED DESCRIPTION OF THE INVENTION

In the method in JP-A 10-25660 supra, slight wrinkles in clothes can be removed, but complete removal of deep wrinkles is difficult. In JP-A 10-058911 and JP-A 1-6174 supra, wrinkles cannot be sufficiently removed by mere natural drying, while ironing is very effective at removing wrinkles, but is troublesome work and may deteriorate the texture. In JP-A 2003-533598 supra, the wrinkle-removing performance is not sufficient.

Under these circumstances, there is desire for development of a wrinkle-removing composition capable of removing wrinkles in fiber products without deteriorating the texture, even if heat treatment such as ironing and steam pressing is not carried out.

The present invention provides a wrinkle-removing composition capable of removing wrinkles in fiber products without deteriorating the texture, even if heat treatment such as ironing and steam pressing is not carried out.

The wrinkle-removing composition of the present invention can remove wrinkles in fiber products without deteriorating the texture, even if heat treatment such as ironing and steam pressing is not carried out. The wrinkle-removing composition of the present invention doesn't make stains and is removed sufficiently in cleaning.

<Component (a)>

In formula (1) for the component (a) , $R^1$ is a hydrocarbon group having 10 to 22 carbon atoms, preferably an alkyl or alkenyl group having 12 to 20 carbon atoms, more preferably 12 to 18 carbon atoms, even more preferably an alkyl group having 16 to 18 carbon atoms. The number of moles of propylene oxide ($C_3H_6O$ group, hereinafter referred to sometimes as PO) added on the average, that is, m, is preferably a number of 3 to 100, more preferably 3 to 60, even more preferably 10 to 60; the number of moles of ethylene oxide ($C_2H_4O$ group, hereinafter referred to sometimes as EO) added on the average, that is, n, is preferably a number of 1 to 10, more preferably 1 to 9, even more preferably 1 to 8; the molar ratio of PO/EO, that is, m/n, is preferably 3 to 12, more preferably 4 to 10. Y is more preferably —O— or —COO—, even more preferably —O—, and (PO) and (EO) may be added in a random or block form, and the order in which (PO) and (EO) are added is not limited, but (PO) and (EO) are added preferably a block form, and particularly a compound represented by formula (3) below is more preferable. The numbers of PO or EO moles added on the average can be determined by NMR.

$$R^1—O—(PO)_m—(EO)_n—H \quad (3)$$

<Component (b)>

By using the components (a) and (b) simultaneously, a wrinkle-removing composition improving the ability of the component (a) to remove wrinkles and being satisfactory from the viewpoint of texture can be obtained in the present invention.

In formula (2) for the component (b), $R^2$ is a hydrocarbon group having 5 to 20 carbon atoms, preferably a linear or branched alkyl or alkenyl group having 5 to 18 carbon atoms, preferably 5 to 16 carbon atoms, more preferably 5 to 12 carbon groups, more preferably a linear or branched alkyl group having 6 to 10 carbon atoms. Z is —O— or —COO—, more preferably —O—.

<Wrinkle-Removing composition>

The contents of the components (a) and (b) in the wrinkle-removing composition of the present invention can be regulated suitably depending on the type of usage, the type of fiber products, and the degree of wrinkles.

The content of the component (a) in the composition is usually 0.01% by mass or more, preferably 0.01 to 10% by mass, more preferably 0.01 to 8% by mass, even more preferably 0.01 to 5% by mass, even more preferably 0.01 to 3% by mass, even more preferably 0.01 to 2% by mass.

The content of the component (b) in the composition is usually 0.01% by mass or more, preferably 0.01 to 10% by mass, more preferably 0.01 to 8% by mass, even more preferably 0.01 to 5% by mass, even more preferably 0.01 to 3% by mass, even more preferably 0.01 to 2% by mass.

For further improving the effect of the component (a), the compounding ratio of the component (a) to the component (b) , that is, the ratio of (a)/(b) by mass, is preferably 10/1 to 1/10, more preferably 8/1 to 1/8, even more preferably 5/1 to 1/5, even more preferably 4/1 to 1/4, even more preferably 3/1 to 1/3.

In the wrinkle-removing composition of the present invention, the remainder other than the components (a) and (b) can be water. If necessary, a surfactant, polyhydric alcohols, a deodorant, generally added various solvents, a gelling agent, salts such as sodium sulfate and N,N,N-trimethylglycine, and other components such as a pH adjusting agent, an antioxidant, a preservative, a bacteriocidal agent/antibacterial agent, a perfume, a coloring agent and a UV absorber may be added in such a range that the effect of the present invention is not impaired.

The surfactant is not particularly limited, and mention may be made of at least one member selected from a nonionic surfactant, a cationic surfactant, an anionic surfactant and an amphoteric surfactant. Among these surfactants, the nonionic surfactant is preferable, and a compound represented by the following formula (4) is particularly preferable from the viewpoint of wrinkle removing performance.

$$R^3—Z—[(EO)_s/(PO)_t]—R^4 \quad (4)$$

wherein $R^3$ is an alkyl or alkenyl group having 10 to 22 carbon atoms, $R^4$ is a hydrogen atom or an alkyl group having 1 to 3 carbon atoms, Z is —O— or —COO—, EO is ethylene oxide, PO is propylene oxide, (EO) and (PO) may be added in a random or block form, and the order in which (EO) and (PO) are added is not limited; s and t each represent the number of moles added on the average, the sum of s and t is a number of 5 to 15, and t is a number of 2 or less.

From the viewpoint of improving the wrinkle removing performance, $R^3$ in the compound represented by formula (4) is an alkyl or alkenyl group having preferably 10 to 18 carbon atoms, more preferably 10 to 16 carbon atoms, even more preferably 10 to 14 carbon atoms, $R^4$ is preferably a hydrogen atom or an alkyl group having 1 to 2 carbon atoms, more preferably a hydrogen atom or a methyl group, even more preferably a hydrogen atom.

In formula (4), s is preferably a number of 5 to 14, more preferably 5 to 13, even more preferably 5 to 12, and t is preferably 0. The compound represented by formula (4) is even more preferably at least one member selected from polyoxyethylene (n=6 to 12) lauryl ether, polyoxyethylene (n=5 to 12) monoalkyl (C12 to C14 secondary hydrocarbon group) ether, and lauric polyoxyethylene (n=6 to 13) methyl ether.

The solvent includes water, ethanol, lower (C3 to C4) alcohols such as isopropanol, polyhydric alcohols (number of carbon atoms: 2 to 12) such as ethylene glycol, propylene glycol, glycerin and sorbitol, monoethyl or monobutyl ether of ethylene glycol or propylene glycol, monoethyl or monobutyl ether of diethylene glycol or dipropylene glycol, benzyl alcohol, benzyloxy ethanol, and ethylene oxide or propylene oxide adducts to a phenol compound.

The pH of the wrinkle-removing composition of the present invention at 25° C. is regulated preferably in the range of 6 to 9.5, and from the viewpoint of reducing stimulation of the skin, the pH is preferably 6.5 to 9.5, more preferably 6.8 to 9.

The pH of the wrinkle-removing composition of the present invention can be regulated by adding an acid such as hydrochloric acid or an alkali such as sodium hydroxide.

The wrinkle-removing composition of the present invention can be used in a liquid state, a gelled state, a powdered state, a granulated solid state or the like. The composition in a liquid state can be used particularly as a spray, lotion etc. in fiber products. The wrinkle-removing composition of the present invention is even more preferably a liquid wrinkle-removing composition, especially an aqueous wrinkle-removing composition which is charged in a mist-type spray container and regulated such that it is sprayed once in an amount 0.1 to 1 ml. The spray container that can be used include spray containers known in the art, such as trigger spray containers (direct pressure type or pressure accumulation type) and pump spray containers of dispenser type. That is, a spray wrinkle-removing agent prepared by charging a spray container with the wrinkle-removing composition of the present invention, particularly with the liquid wrinkle-removing composition, can be obtained in the present invention. Preferably, the composition of the present invention is sprayed onto a fiber product to adhere to it thereby reducing wrinkles in the object, and the spray wrinkle-removing agent is used preferably in this method. The fiber product includes clothes such as suits and sweaters, as well as curtains and sofas.

EXAMPLES

The Examples below describe the practice of the present invention. The Examples are merely illustrative of the present invention and are not intended to limit the present invention.

Examples 1 to 5 and Comparative Examples 1 to 2

<Preparation of Wrinkle-Removing Compositions>

Wrinkle-removing compositions were prepared according to the formulations shown in Table 1. The nonionic surfactant used was a surfactant having ethylene oxides having 8 moles on the average of EO added to a linear primary alcohol having 12 carbon atoms; the antibacterial agent used was Proxel BDN (10% aqueous solution, manufactured by Avecia, Ltd.) ; and the perfume used was a perfume preparation containing 5 parts by mass of ethyl cinnamate, 10 parts by mass of linalyl acetate, 15 parts by mass of Lyral, 10 parts by mass of hexyl cinnamic aldehyde, 10 parts by mass of Perlide, 20 parts by mass of phenyl ethyl aldehyde, 10 parts by mass of cedar alcohol and 20 parts by mass of limonene. The resulting composition was adjusted to pH 8 (25° C.) with a pH adjusting agent, that is, 1 N aqueous hydrochloric acid or 1/10 N aqueous sodium hydroxide. Components expressed in the symbols in Table 1 are as follows:

Component (a)

a-1: Compound of formula (3) wherein $R^1$ is a linear alkyl group having 18 carbon atoms, m is a number of 38, and n is a number of 6.

a-2: Compound of formula (3) wherein $R^1$ is a linear alkyl group having 16 carbon atoms, m is a number of 15, and n is a number of 3.

a-3: Compound of formula (3) wherein $R^1$ is a linear alkyl group having 12 carbon atoms, m is a number of 25, and n is a number of 3.

a-4: Compound of formula (1) wherein $R^1$ is a linear alkyl group having 18 carbon atoms, Y is —O—, m is a number of 38, n is a number of 6, and (EO) and (PO) were added in this order in a block form to $R^1$—Y— (that is, a compound of $R^1$—Y-$(EO)_n$-$(PO)_m$-H)

a-5: Compound of formula (1) wherein R is a linear alkyl group having 18 carbon atoms, Y is —O—, m is a number of 30, n is a number of 5, and (PO) and (EO) are added in a random form.

Component (b)

b-1: Compound of formula (2) wherein $R^2$ is a linear alkyl group having 6 carbon atoms, and Z is —O—.

b-2: Compound of formula (2) wherein $R^2$ is a 2-ethylhexyl group, and Z is —O—.

b-3: Compound of formula (2) wherein $R^2$ is a linear alkyl group having 7 carbon atoms, and Z is —COO—.

<Wrinkle Removing Effect>

(1) Wrinkling Method

A test cloth 20×10 cm made of a wool fabric (wool serge, Yato Shoten Co., Ltd.) was moistened by spraying with ion-exchanged water and then folded in two, and after the folded portion was loaded with a weight of 2 kg in a thermostatic chamber set at 40° C., the test cloth was left in such a state for 24 hours, thereby providing the test cloth with a wrinkle which was then used as a model wrinkle for evaluating winkle removal.

(2) Wrinkle Removing Method

The test cloth with the model wrinkle was sprayed by a spray container (T-7500, manufactured by Canyon Corporation), with the wrinkle-removing composition in Table 1 in an amount of 50% by mass based on the dry mass of the test cloth, and then left for 12 hours in a thermostatic chamber at 25° C./50% RH, thereby air-drying it. After drying was finished, the degree of removal of the wrinkle from the test cloth was judged.

(3) Evaluation of Wrinkle Removing Performance

In the judgment, the cloth treated by spraying with the wrinkle-removing composition, and the cloth (control) before the treatment, were scored respectively by a panel of 5 skilled persons by the following criteria to determine the average score. The results are shown in the Table. In this evaluation, the average is preferably less than 3.

1: There is no wrinkle.

2: There is little wrinkle.

3: The winkle slightly remains.

4: The winkle fairly remains.

5: The wrinkle significantly remains.

<Evaluation of Texture>

A test cloth 40×40 cm made of a wool fabric (wool serge, Yato Shoten Co., Ltd.) was sprayed with the wrinkle-removing composition in Table 1 in an amount of 50% by mass based on the dry weight of the test cloth and then left for 12 hours in a thermostatic chamber at 25° C./50% RH, thereby air-drying it. After drying was finished, the texture of the test cloth was judged. In the judgment, the cloth treated by spraying with the wrinkle-removing composition, and the cloth (control) before the treatment, were scored respectively by a panel of 5 skilled persons by the following criteria to determine the average score. The results are shown in the Table. In this evaluation, the average is preferably from 0 (exclusive) to +1.

+1: Smoother than the control.

0: Equal to the control.

−0: Rougher than the control.

TABLE 1

| | | | Example | | | | | comparative example | |
|---|---|---|---|---|---|---|---|---|---|
| | | | 1 | 2 | 3 | 4 | 5 | 1 | 2 |
| Formulation (mass %) | Component (a) | a-1 | 0.1 | | | | | | 0.1 |
| | | a-2 | | 0.1 | | | | | |
| | | a-3 | | | 0.1 | | | | |
| | | a-4 | | | | 0.1 | | | |
| | | a-5 | | | | | 0.2 | | |
| | Component (b) | b-1 | | | 0.1 | | | 0.1 | |
| | | b-2 | 0.1 | | | 0.1 | | | |
| | | b-3 | | 0.1 | | | 0.1 | | |
| | Nonionic surfactant | | 0.1 | 0.1 | 0.1 | 0.1 | 0.1 | 0.1 | 0.1 |
| | Antibacterial agent | | 0.1 | 0.1 | 0.1 | 0.1 | 0.1 | 0.1 | 0.1 |
| | Perfume | | 0.01 | 0.01 | 0.01 | 0.01 | 0.01 | 0.01 | 0.01 |
| | pH adjusting agent | | Amount to adjust pH to 8 | | | | | | |
| | Ion-exchanged water | | Balance | Balance | Balance | Balance | Balance | Balance | Balance |
| | Total | | 100 | 100 | 100 | 100 | 100 | 100 | 100 |
| Wrinkle removing effect | | | 1.2 | 1.8 | 2.5 | 2.5 | 2.5 | 4.5 | 2.5 |
| Texture | | | 0.6 | 0.5 | 0.4 | 0.5 | 0.5 | −0.5 | 0 |

As can be seen from Table 1, the texture-imparting effect of the compositions in Comparative Examples 1 and 2 is insufficient, and the wrinkle-removing performance in Comparative Example 1 is also insufficient, while the wrinkle-removing performance of the wrinkle-removing compositions in Examples 1 to 5 is high, and the texture-imparting effect in Examples 1 to 5 is excellent.

The invention claimed is:

1. A wrinkle-removing composition comprising (a) a compound represented by formula (1) and (b) a compound represented by formula (2):

$$R^1—Y—[(PO)_m/(EO)_n]—H \quad (1)$$

wherein $R^1$ is a hydrocarbon group having 10 to 22 carbon atoms, PO represents $C_3H_6O$, EO represents $C_2H_4O$, m and n each represent the added mole number on the average, m is a number of 3 to 100, n is a number of 1 to 10, m/n is 4 to 10, (PO) and (EO) may be added in a random or block form, and the order in which (PO) and (EO) are added is not limited; and Y is —O—, —COO—, —CONH— or —NHCO—, $$R^2—Z—CH_2CH(OH)CH_2OH \quad (2)$$

wherein $R^2$ represents a hydrocarbon group having 5 to 20 carbon atoms, and Z is —O— or —COO—.

2. A method of removing wrinkles from clothes, which comprises applying the composition of claim 1 onto clothes.

3. A method of removing wrinkles from a fabric comprising applying a wrinkle-removing composition to the fabric, wherein the wrinkle-removing composition comprises (a) a compound represented by formula (1) and (b) a compound represented by formula (2):

$$R^1—Y—[(PO)_m/(EO)_n]—H \quad (1)$$

wherein $R^1$ is a hydrocarbon group having 10 to 22 carbon atoms, PO represents $C_3H_6O$, EO represents $C_2H_4O$, m and n each represent the added mole number on the average, m is a number of 3 to 100, n is a number of 1 to 10, m/n is 4 to 10, (PO) and (EO) may be added in a random or block form, and the order in which (PO) and (EO) are added is not limited; and Y is —O—, —COO—, —CONH— or —NHCO—, $$R^2—Z—CH_2CH(OH)CH_2OH \quad (2)$$

wherein $R^2$ represents a hydrocarbon group having 5 to 20 carbon atoms, and Z is —O— or —COO—.

4. The method of claim 3, wherein the fabric is part of a curtain, a sofa or a piece of clothing.

5. The wrinkle-removing composition of claim 1, further comprising at least one of an additional surfacant, a polyhydric alcohol, a deodorant, a solvent, a gelling agent, a salt, a pH adjusting agent, an antioxidant, a preservative, a bactericidal agent, an antibacterial agent, a perfume, a coloring agent, and a UV absorber.

6. The wrinkle-removing composition of claim 1, wherein the wrinkle-removing composition is a liquid.

7. The wrinkle-removing composition of claim 1, wherein the ratio of compound (a) to compound (b) is between 10/1 and 1/10.

8. The wrinkle-removing composition of claim 1, wherein $R^1$ is a linear alkyl group having 18 carbon atoms, Y is —O—, m is 38 and n is 6.

9. The wrinkle-removing composition of claim 1, wherein $R^1$ is a linear alkyl group having 18 carbon atoms, m is 30 and n is 5.

10. The wrinkle-removing composition of claim 1, wherein $R^2$ is a linear alkyl group having 6 carbon atoms and Z is —O—.

11. The wrinkle-removing composition of claim 1, wherein $R^2$ is a 2-ethylhexyl group and Z is —O—.

12. The wrinkle-removing composition of claim 1, wherein $R^2$ is a linear alkyl group having 7 carbon atoms and Z is —COO—.

13. The wrinkle-removing composition of claim 1, wherein Y is —COO—, —CONH— or —NHCO—.

* * * * *